US005725407A

United States Patent [19]

Liu et al.

[11] Patent Number: 5,725,407

[45] Date of Patent: Mar. 10, 1998

[54] PROCESS FOR MANUFACTURING A LUMINESCENT DISPLAY SCREEN THAT FEATURES A SLOPING STRUCTURE

[75] Inventors: Nan-Chou D. Liu, Chutung; Jammy Chin-Ming Huang; Jin-Yuh Lu, both of Taipei, all of Taiwan

[73] Assignee: Industrial Technology Research Institute, Hsinchu, Taiwan

[21] Appl. No.: 630,707

[22] Filed: Apr. 8, 1996

[51] Int. Cl.[6] ..... H01J 9/227

[52] U.S. Cl. ..... 445/52; 427/68

[58] Field of Search ..... 445/52; 427/68; 430/23, 25

[56] References Cited

U.S. PATENT DOCUMENTS 4,243,735 1/1981 Kobale et al. ..... 427/68 X 4,325,002 4/1982 Kobale et al. ..... 313/485

4,485,158 11/1984 Harper ..... 427/68 X 4,670,296 6/1987 Akiba ..... 427/68

*Primary Examiner*—Kenneth J. Ramsey

*Attorney, Agent, or Firm*—George O. Saile; Stephen B. Ackerman

[57] ABSTRACT

A process is described for the manufacture of a luminescent screen that eliminates image distorting or crosstalk effects resulting from secondary and back-scattered electrons that end up in adjoining sub-pixels. An unusually thick (ca. 70 microns) black matrix is first formed on the substrate surface and is given a tapered cross-sectional shape such that it is smaller at its top surface than at the substrate surface. Said tapered profile may be achieved through a screen-on process or by an overetching process. This is followed by the deposition of a transparent conductive layer, such as ITO, onto which the various layers of different phosphors that make up the sub-pixels of the display are deposited by means of electrophoresis.

18 Claims, 4 Drawing Sheets

PROCESS FOR MANUFACTURING A LUMINESCENT DISPLAY SCREEN THAT FEATURES A SLOPING STRUCTURE

BACKGROUND OF THE INVENTION (1) Field of the Invention

The invention relates to the general field of luminescent screens, more particularly to color screens in cathode ray tubes and flat panel displays and to methods for manufacturing them.

(2) Description of the Prior Art

Color screens for cathode ray tubes or plasma displays comprise, primarily, a plurality of small regions each covered by a layer of phosphor. Usually three different color-generating phosphors are used, one for blue light, one for red light and one for green light. Said regions act as sub-pixels for the display and their possible shapes include dots and stripes.

The various regions that constitute the sub-pixels are arranged so as not to overlap with one another. It is important to see that no light can emerge from within the display tube through the space between the sub-pixels. Accordingly, the space between the sub-pixels is most commonly filled with a non-reflecting, non-transmitting layer called a black matrix.

A variety of methods exist for depositing the phosphor layers, the most common being in the form of either a slurry or a dry powder onto an adhesive surface. If selective electrical contact can be made to areas on which it is desired to deposit a phosphor layer, such selective deposition can be accomplished by means of electrophoresis in a manner analagous to electroplating metal from solution onto selected sites.

Similarly, there exists a variety of methods for depositing the black matrix and then forming it into its desired shape. Among the most commonly used are screening, wherein a black opaque paste is forced through a fine mesh, parts of which have been blocked by material so as to form a negative of the desired pattern, and photolithographic methods wherein an etch resistant layer is deposited over a continous layer of black matrix material and then patterned to form an etch mask.

The screening methods tend to be fast, and hence economical, but the achievable resolution is relatively limited. The photolithographic methods tend to be time consuming, and hence expensive, but are capable of achieving high resolution.

In the interests of achieving the highest resolution, it is common practice to make the black matrix just thick enough to be able to perform its light blocking function, and nothing more. A typical thickness for this style of black matrix would be about 20 microns. The sub-pixel areas comprising the various phosphor layers are then formed so as to be slightly thicker than the black matrix as well as to overlap it slightly, thereby ensuring that the substrate area is everywhere covered by either phosphor or black matrix.

A serious disadvantage of this structure is that its geometry is not well suited to dealing with electrons that do not reach the phosphors directly from the image-generating electron beam or beams. Such electrons may be the result of electrons from the main beam having been back-scattered by the phosphor and/or anode layer or they could be secondary electrons emitted by phosphor or anode. Whatever their origin, such non-imaging electrons can lead to additional luminescence, particularly in adjoining pixels or sub-pixels, beyond what was programmed into the imaging electron beam, thereby reducing the fidelity of the final displayed image.

A solution to this problem has been described by Kobale et al. (U.S. Pat. No. 4,325,002 April 1982). In their structure, relatively deep grooves are first formed in the substrate suface. The black matrix is then formed on the peaks (original substrate surface) while the phosphor layer is formed on the bottom and side walls of the grooves. Any secondary or back-scattered electrons generated within a groove remain inside it striking, at worst, its own side walls. Since each groove corresponds to a single sub-pixel, unintended luminescence in adjoining sub-pixels can no longer occur. However, while the Kobale structure achieves its intended result, the cost of manufacturing it tends to be unattractively high.

SUMMARY OF THE INVENTION

It has been an object of the present invention to provide processes for manufacturing a luminescent screen that is not subject to image distortion or crosstalk as a result of secondary or back-scattered electrons reaching sub-pixels for which they were not intended.

A further object of the present invention has been that said processes should be low cost.

Yet another object of the present invention has been that the products resulting from said processes perform as well as, or better than, products resulting from the processes in current use.

These objects have been achieved by the provision of a process for luminescent screen manufacture wherein an unusually thick (ca. 70 microns) black matrix is first formed on the substrate surface and is given a tapered cross-sectional shape such that it is smaller at its top surface than at the substrate surface. Said tapered profile may be achieved through a screen-on process or by an overetching process. This is followed by the deposition of a transparent conductive layer, such as ITO, onto which the various layers of different phosphors that make up the sub-pixels of the display are deposited by means of electrophoresis.

DESCRIPTION OF THE PREFERRED EMBODIMENTS

As discussed above, the use of a grooved structure for the black matrix and sub-pixels of a luminescent screen offers several advantages with respect to reducing the image spoiling or crosstalk effects of back-scattered and secondary electrons. The present invention is concerned with ways to manufacture such a grooved structure without increasing costs relative to the more conventional flat structures.

Figure 1:
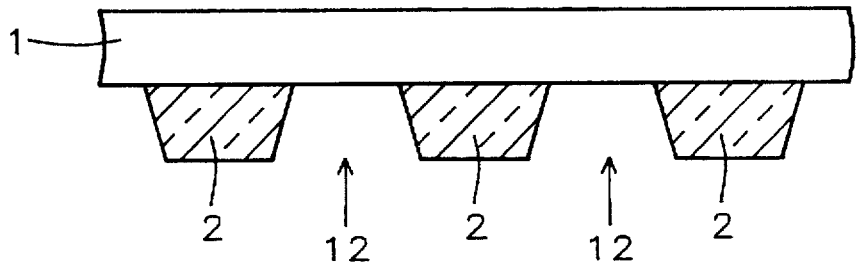
FIGS. 1 to 4 illustrate, through schematic cross-sections, a series of steps that exemplify a first embodiment of the present invention.

The process for manufacturing a first embodiment of the present invention begins with the structure shown, in schematic cross-section, in FIG. 1. In general, the surface of subsrate 1 will be the smooth inward-facing surface of the face plate of a cathode ray tube or plasma display. Black matrix 2 has been formed on said surface by a low cost screening process using carbon paste or silica paste. The screening conditions were chosen so as to cause the black matrix to have the type of profile shown in the figure, that is, a generally tapered shape, wider at the bottom and narrower at the top. The thickness of the black matrix was typically about 70 microns but any thickness in the range of from about 20 to 150 microns could be used. Exposed substrate areas 12, between the lines of the black matrix and having a width of about 70 microns, will be used as sites for the sub-pixels of the display.

Figure 2:
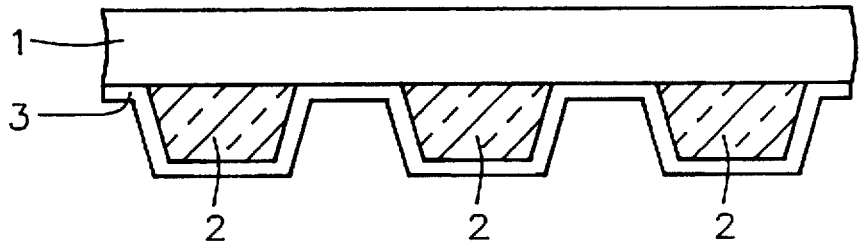

Referring now to FIG. 2, layer 3 of a transparent conductive material such as indium tin oxide is deposited by means of sputtering onto the surfaces of both the substrate 1 and black matrix 2 to a thickness between about 1,000 and 2,000 Angstroms. Layer 3 is then selectively removed from the top surfaces of the black matrix grooves, so as to uncover it in areas such as 4 in FIG. 3.

Electrical contact is now made to those areas where a red phosphor (for example) is needed. The structure is immersed in a slurry of red phosphor particles averaging about 4 microns in size, suspended in an electrolyte, and by the application of negative voltage to the aforementioned selected sub-pixel areas a layer of red phosphor is caused to deposit there as a result of electrophoresis. Voltage is applied for about 0.5 minutes, resulting in the buildup of a phosphor layer about 20 microns thick.

The process of electrophoretic deposition is then repeated for whatever additional phosphor layers it is desired to form, generally green and blue phosphors. It should be noted that the number of different phosphor regions and the order of their formation is not important with respect to the workability of the present invention and the set red, green, blue has been used here merely by way of illustration.

Figure 4:
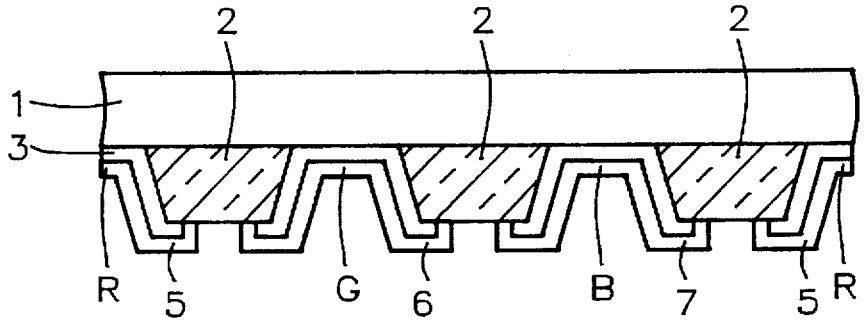

Once the formation of all the phosphor regions has been completed the structure has the appearance shown in FIG. 4 where the red phosphor has been (arbitrarily) designated as 5, the green phosphor as 6, and the blue phosphor as 7.

Figure 5:
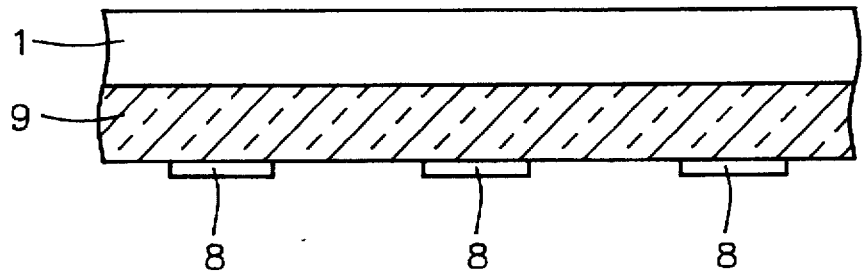
FIGS. 5 to 8 illustrate steps that exemplify a second embodiment of the present invention.

In a second embodiment of the present invention, the starting point of the process is a suitable substrate of the type described for the first embodiment but, instead of being formed through a screening process, the material from which the black matrix is to be formed is first deposited as continuous layer 9 as shown in FIG. 5. Layer 9 comprises silica paste or carbon paste and is deposited by means of spin coating, screen printing, or similar technique. The thickness of layer 9 was typically about 70 microns but any thickness in the range of from about 20 to 150 microns could be used.

Figure 6:
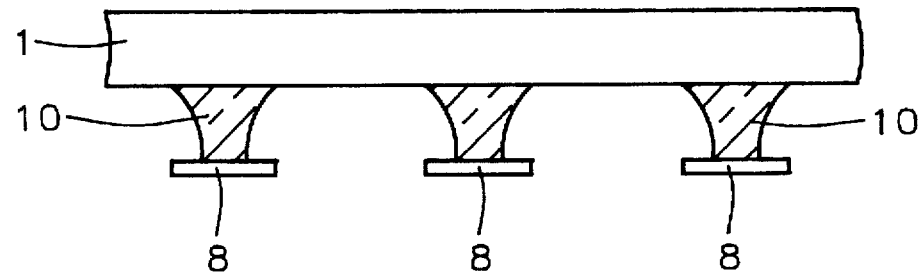

Photoresist mask 8 is then applied to the surface of layer 9. Said mask represents an image of the intended black matrix but is deliberately made oversize (undersized pixel areas). Layer 9 is then etched down to the level of substrate 1 using hydrofluoric acid (for the silica paste). Etching is allowed to continue beyond the point where the surface of 1 becomes uncovered. That is, layer 9 is overetched. As a result of the overetching, resist mask 8 is significantly undercut and the resulting black matrix 10 has a tapered shape, as illustrated in FIG. 6.

Figure 7:
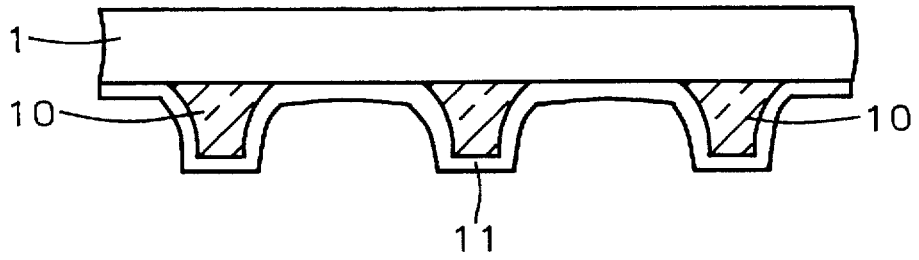
Figure 8:
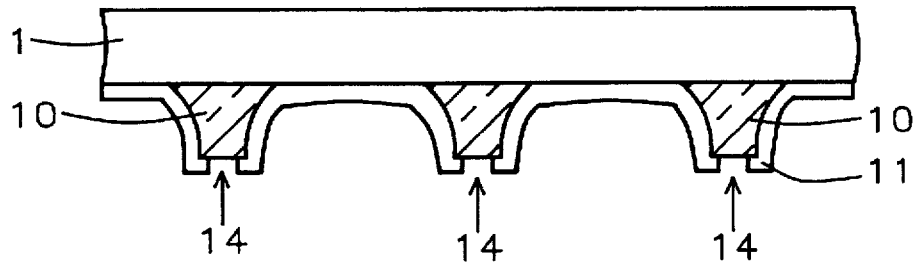

Referring now to FIG. 7, resist mask 8 has been stripped away, using standard techniques, and layer 11 of a transparent conductive material such as indium tin oxide is deposited by means of sputtering onto the surfaces of both the substrate 1 and black matrix 10 to a thickness between about 1,000 and 2,000 Angstroms. Layer 11 is then selectively removed from the top surfaces of the black matrix grooves, so as to uncover it in areas such as 14 in FIG. 8.

Figure 3:
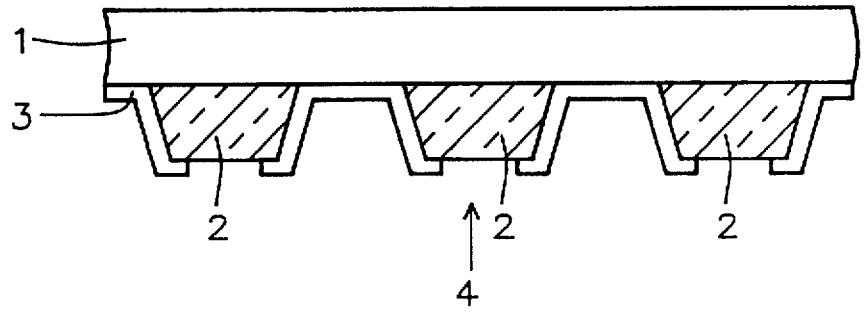

The process of the second embodiment is now completed in the same manner as was described for the first embodiment, once the structure shown in FIG. 3 had been formed. That is, electrical contact is made to selected areas of layer 11 and the various phosphor layers are formed on selected regions of layer 11, as desired, by means of electrophoresis. At the completion of the process of the second embodiment, the structure is then essentially as was shown for the first embodiment in FIG. 4.

Figure 9:
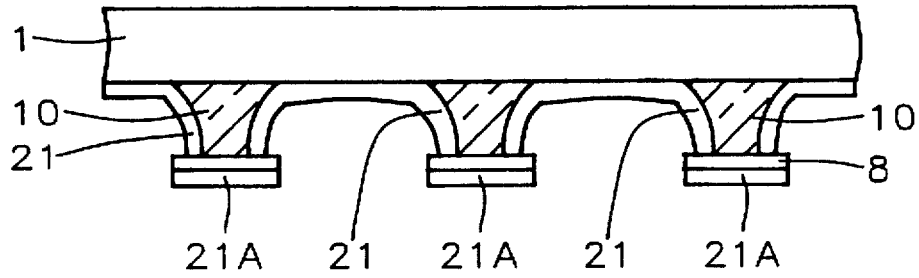
FIGS. 9 and 10 illustrate a variation on the process of the second embodiment, thereby providing a third embodiment.

Referring once again to FIG. 6, in a third embodiment of the present invention photoresist mask 8 is not removed after the overetching step, as was the case in the second embodiment. Instead, as illustrated in FIG. 9, layer 21 of a transparent conductive material such as indium tin oxide is deposited, by means of sputtering, onto the surfaces of substrate 1 and resist mask 8, as well as onto the side-walls of black matrix 10, to a thickness between about 1,000 and 2,000 Angstroms.

Figure 10:
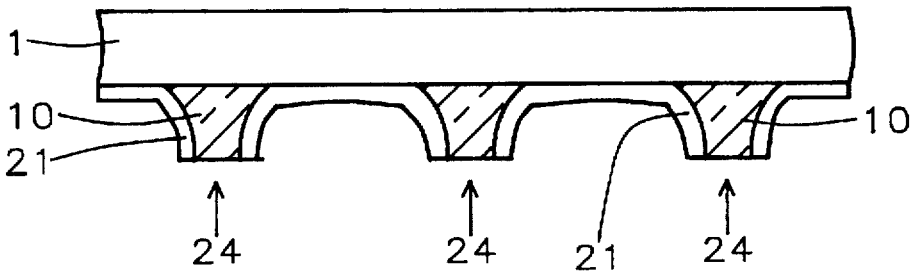

Photoresist mask 8 is then removed using a standard photoresist stripper to dissolve layer 8 and to lift off layer 21 so that portions 21A of layer 21 are removed along with resist mask 8. At the completion of liftoff the structure has the appearance illustrated in FIG. 10. The top surfaces 24 of black matrix 10 have now been fully uncovered and the process of the third embodiment is completed in the same manner as was used for the prior embodiments. That is, electrical contact is made to selected areas of layer 21 and the various phosphor layers are formed on selected regions of layer 21, as desired, by means of electrophoresis. At the completion of the process of the third embodiment, the structure is then essentially as was shown for the first two embodiments in FIG. 4 except that layer 21 does not overlap the top of black matrix 10.

While the invention has been particularly shown and described with reference to the preferred embodiments thereof, it will be understood by those skilled in the art that various changes in form and details may be made without departing from the spirit and scope of the invention.

What is claimed is:

1. A method for manufacturing a color luminescent screen comprising:

(a) providing a glass substrate having a smooth surface;

(b) by means of screen printing, forming a black matrix, on said surface, said black matrix further comprising a patterned layer having an upper surface and sloping edges such that said black matrix is larger at the level of the substrate surface than at the level of said upper surface;

(c) depositing a layer of a transparent conductor on said substrate and on said black matrix;

(d) selectively etching said transparent conductor so that it is removed from the upper surface of the black matrix; and (e) forming, by means of electrophoresis, blue, green, and red phosphor areas over said transparent conductor.

2. The method of claim 1 wherein said black matrix comprise silica paste or carbon paste.

3. The method of claim 1 wherein said black matrix is formed to a thickness between about 20 and 150 microns.

4. The method of claim 1 wherein said transparent conductor comprises indium tin oxide.

5. The method of claim 4 wherein said layer of indium tin oxide is deposited by means of sputtering.

6. The method of claim 1 wherein said layer of a transparent conductor is deposited to a thickness between about 1,000 and 2,000 Angstroms.

7. A method for manufacturing a color luminescent screen comprising:

(a) providing a glass substrate having a smooth surface;

(b) depositing a layer of a black opaque material having an upper surface onto said substrate surface;

(c) depositing a layer of photoresist onto said layer of black opaque material and then patterning the photoresist to form a mask having the shape of an oversize black matrix;

(d) then overetching said layer of black opaque material down to the level of said substrate surface thereby undercutting said mask and forming, on said substrate surface, a black matrix having an upper surface and sloping edges such that the black matrix is larger at the level of the substrate surface than at the level of said upper surface;

(e) removing said layer of photoresist;

(f) depositing a layer of a transparent conductor on said substrate and on said black matrix;

(g) selectively etching said transparent conductor so that it is removed from said upper surface of the black matrix; and (h) forming, by means of electrophoresis, blue, green, and red phosphor areas over said transparent conductor.

8. The method of claim 7 wherein said layer of a black opaque material comprises carbon paste or silica paste.

9. The method of claim 7 wherein said layer of a black opaque material is deposited to a thickness between about 20 and 150 microns.

10. The method of claim 7 wherein said transparent conductor comprises indium tin oxide.

11. The method of claim 10 wherein said layer of indium tin oxide is deposited by means of sputtering.

12. The method of claim 7 wherein said layer of a transparent conductor is deposited to a thickness between about 1,000 and 2,000 Angstroms.

13. A method for manufacturing a color luminescent screen comprising:

(a) providing a glass substrate having a smooth surface;

(b) depositing a layer of a black opaque material having an upper surface onto said substrate surface;

(c) depositing a layer of photoresist onto said layer of black opaque material and then patterning the photoresist to form a mask having the shape of an oversize black matrix;

(d) then overetching said layer of black opaque material down to the level of said substrate surface thereby undercutting said mask and forming, on said substrate surface, a black matrix having an upper surface and sloping edges such that the black matrix is larger at the level of the substrate surface than at the level of said upper surface;

(e) depositing a layer of a transparent conductor on said substrate, on said black matrix, and on said photoresist layer;

(f) removing said layer of photoresist thereby lifting off said transparent conductor from above said upper surface of the black matrix; and (h) forming, by means of electrophoresis, blue, green, and red phosphor areas over said transparent conductor.

14. The method of claim 13 wherein said layer of a black opaque material comprises carbon paste or silica paste.

15. The method of claim 13 wherein said layer of a black opaque material is deposited to a thickness between about 20 and 150 microns.

16. The method of claim 13 wherein said transparent conductor comprises indium tin oxide.

17. The method of claim 16 wherein said layer of indium tin oxide is deposited by means of sputtering.

18. The method of claim 13 wherein said layer of a transparent conductor is deposited to a thickness between about 1,000 and 2,000 Angstroms.

* * * * *